US007205873B2

(12) United States Patent
Dudding et al.

(10) Patent No.: US 7,205,873 B2
(45) Date of Patent: Apr. 17, 2007

(54) METHOD OF AND AN APPARATUS FOR MAGNETISING A PLURALITY OF ADJACENT PORTIONS OF MAGNETISABLE MATERIAL

(75) Inventors: John Dudding, Falmouth (GB); Robin Nathan Cornelius, Newquay (GB)

(73) Assignees: Hirst Magnetic Instruments Limited, Cornwall (GB); Newage International Limited, Lincolnshire (GB)

( * ) Notice: Subject to any disclaimer, the term of this patent is extended or adjusted under 35 U.S.C. 154(b) by 226 days.

(21) Appl. No.: 10/416,652

(22) PCT Filed: Nov. 14, 2001

(86) PCT No.: PCT/GB01/05052

§ 371 (c)(1),
(2), (4) Date: Jun. 4, 2003

(87) PCT Pub. No.: WO02/41334

PCT Pub. Date: May 23, 2002

(65) Prior Publication Data

US 2004/0051611 A1 Mar. 18, 2004

(30) Foreign Application Priority Data

Nov. 15, 2000 (GB) ..... 0027925.7
Sep. 12, 2001 (GB) ..... 0122032.6

(51) Int. Cl.
*H01F 13/00* (2006.01)

(52) U.S. Cl. ..... 335/284

(58) Field of Classification Search ..... 335/284
See application file for complete search history.

(56) References Cited

U.S. PATENT DOCUMENTS 4,707,677 A * 11/1987 Oudet ..... 335/284
6,744,341 B2 * 6/2004 Iwami et al. ..... 335/284
6,853,280 B2 * 2/2005 Sugawara et al. ..... 335/284

FOREIGN PATENT DOCUMENTS

FR 1284945 A 2/1962
FR 2502386 A 9/1982
JP 62 274608 A 11/1987

* cited by examiner

*Primary Examiner*—K. Lee
*Assistant Examiner*—Bernard Rojas
(74) *Attorney, Agent, or Firm*—Hamre, Schumann, Mueller & Larson P.C.

(57) ABSTRACT

A method of magnetizing members of magnetizable material (210) including presenting a magnetizer head to a circular array of the members (210) mounted on a rotor plate (200) of an electrical machine. The magnetizer head includes a circular array of coils (142), each coil (142) being positioned adjacent a respective one of the members (210). A current is supplied to selected juxtaposed pairs of the coils (142) so as to set up a magnetic field. Flux of the field forms a closed loop through the pair of coils (142) and the adjacent pair of members (210), such that uncontrolled flux leakage from this loop is minimized and such that the pair of members (210) are at least partially magnetized.

10 Claims, 2 Drawing Sheets

METHOD OF AND AN APPARATUS FOR MAGNETISING A PLURALITY OF ADJACENT PORTIONS OF MAGNETISABLE MATERIAL

BACKGROUND TO THE INVENTION

This invention relates to magnetising members of magnetisable material.

In conventional methods of magnetising magnetisable material, an energised coil of wire is coupled with a member of magnetisable material, thereby causing the member to become magnetised or "energised" as a permanent magnet.

However there are problems associated with magnetising a plurality of adjacent members of unmagnetised magnetisable material. If all the members are to be magnetised simultaneously, an arrangement of many high energy coils would be needed, each carrying a large current so as to set up a strong magnetic field around each coil. Such an arrangement with high currents and strong magnetic fields may be disadvantageous in constituting a health and safety hazard. A more significant disadvantage is that such high energy apparatus is expensive to manufacture and to operate.

JP-A-62274608 discloses a method of magnetising magnetisable members so as to avoid those members having parts that are unmagnetised. Successive pairs of the members are magnetised, with each pair other than a first magnetised pair including one member of a respective previously magnetised pair, and the final pair to be magnetised including a member of the first pair. The method is such that each member is magnetised twice.

JP-A-62274608 recognises that such a method might result in an undesirable demagnetisation action being applied to some of the members, but states that this action would be resisted by the members and would have no effect thereon. This might be the case when magnetising a small number of spaced apart members, but demagnetisation would tend to occur if the method of JP-A-62274608 were used to magnetise a larger number of members, or members that were more closely juxtaposed so as to be susceptible to stray flux from magnetising means.

It is an object of this invention to address these problems.

SUMMARY OF THE INVENTION

According to an aspect of this invention there is provided a method of magnetising a plurality of adjacent portions of magnetisable material mounted on a carrier, the method including the steps of:

a) magnetising a first group of one or more of the portions by operation of magnetising means; and b) magnetising one or more successive groups of one or more of the portions by the operation of the magnetising means, whereby the plurality of adjacent portions can be magnetised sequentially, one group after another, the magnetising means including field generation means operable to generate a magnetic field, flux of which passes through the or each portion in the group that is being magnetised, thereby at least partially magnetising the or each portion, wherein the magnetising means includes control means operable to control the magnetic field such that flux thereof follows a preferred path through the or each portion that is being magnetised and through the magnetising means in a substantially closed loop and whereby uncontrolled flux leakage from the or each portion and the magnetising means is minimised.

Prior to the commencement of step (a) the portions of magnetisable material may be substantially unmagnetised, partially magnetised, or substantially magnetised.

Repeated operation of the magnetising means when presented to the or each portion so as to progressively magnetise that or those portions is advantageous in that the magnetising means may be operated at a lower power than would be necessary to achieve the same level of magnetisation in a single operation. Such lower power operation enables the magnetising means to be constructed from cheaper components that would otherwise be the case.

Controlling the flux path of the magnetic field set up by the magnetising means such that uncontrolled flux leakage is minimised is advantageous in minimising the deleterious effect of such flux leakage on portions other than those being magnetised at that time. The effect of flux leakage may be to demagnetise one or more of the portions.

The carrier may be a component of an electrical machine. The portions may be portions of the same member of magnetisable material, wherein the carrier is that member.

According to another aspect of this invention there is provided magnetising means for magnetising successive groups, each of at least one portion of magnetisable material, the magnetising means being arranged to magnetise the portions sequentially, one group after another, the magnetising means including field generation means operable to generate a magnetic field, flux of which passes through the or each portion in the group that is being magnetised, thereby at least partially magnetising the or each portion, wherein magnetising means includes control means operable to control the magnetic field such that flux thereof follows a preferred path through the or each portion that is being magnetised and through the magnetising means in a substantially closed loop and whereby uncontrolled flux leakage from the or each portion and the magnetising means is minimised.

Some or all of the portions may be portions of the same member of magnetisable material, portions of different members of magnetisable material, or portions of both.

The magnetising means may include one or more permanent magnets and/or one or more current-carrying coils. The control means may control the path of the flux by an arrangement of one or more current-carrying coils, or one or more permanent magnets arranged so as to guide the flux between the portion of magnetisable material to which the magnetisable means have been presented, and the field generating means so as to follow the preferred path therethrough. The field generation means may also act as the control means.

In one embodiment, the magnetising means may include a helical coil, the ends of which have been arranged so as to face each other so that the coil defines a shape that has the appearance of a split ring, or of a rounded horseshoe. The helical coil is preferably arranged such that when an electrical potential is connected across the ends thereof, one end of the helical coil is adjacent a north pole and the other end is adjacent a south pole. The helical coil is preferably further arranged to receive the at least one portion of magnetisable material between its ends and to at least partially magnetise the portion during operation of the magnetising means such that flux passes from the north pole of the helical coil, across a first air gap to the portion, through the portion, across a second air gap to the south pole of the helical coil, and through the inside of the helical coil from the south pole to the north pole thereof, thereby completing a closed loop along the preferred path.

At least one group may include at least one portion that was included in a previous group. At least one group may include at least one portion that is subsequently included in a subsequent group. In other words, the groups may "overlap".

The portions may be arranged in, for example, a linear array, a rectangular array, or a circular array. Preferably, each portion is in juxtaposition with one or more respective portions. The portions may be positioned on a component of an electrical machine, the component being the carrier. Each portion may be a portion of a different respective member of magnetisable material. The members may be positioned in a circular array on a rotor plate of an electrical machine. The members may be plates. The magnetisable material may be a rare-earth material, such as Neodymium-Iron-Boron.

Each portion may have a first surface that faces substantially in a first direction. The first surface of each portion may be magnetised with an opposite polarity to that which is induced in the first surface of the or each juxtaposed portion. The first surface of each portion may be magnetised with the same polarity.

The magnetising means may include one or more coils of wire, the magnetising means being operable to supply an electric current to each coil such that a respective magnetic field is set up around each coil. The magnetising means may be operable such that each coil conducts the same current in series. The magnetising means may be operable such that each coil conducts a respective current.

Where the first surface of each portion is magnetised with an opposite polarity to that which is induced in the first surface of the or each juxtaposed portion, each coil may be positioned adjacent a respective portion, thereby creating a series of coils such that the magnetic field or fields set up around each coil pass or passes through the respective portion, the direction of the respective current in each coil being opposite to the direction of the current in the or each juxtaposed coil such that flux passes through juxtaposed coils in opposite directions, thereby causing the first surface of the respective portion to be induced with either a north-seeking or a south-seeking polarity.

In another embodiment, some of the coils may be principal coils, the remainder being identified in this description as "focusing coils", the principal coils being positioned innermost in the series and the focusing coils being positioned outermost in the series. The principal coils may be considered to act substantially as the field generating means and the focusing coils may be considered to act substantially as the control means. The field associated with each principal coil may be stronger than the field associated with each focusing coil, the strength of the respective field associated with each principal coil being such that the density of the flux passing through the respective portion adjacent thereto is sufficient to substantially magnetise that portion, and the strength of the respective field associated with each focusing coil being such that the density of the flux passing through the respective portion adjacent thereto is not sufficient to substantially magnetise that portion. The field associated with each of the principal coils may be such that flux passing through each principal coil tends to form a closed loop of flux through a respective juxtaposed principal coil and through each of the two portions adjacent the respective two principal coils. The field associated with each of the focusing coils may be such that some of the flux of the field associated with an adjacent principal coil that does not form a closed loop through a respective juxtaposed principal coil forms a closed loop with flux passing through a respective focusing coil, thereby reducing the amount of uncontrolled flux leakage from the adjacent principal coil.

The stronger field around each principal coil may be set up by including more turns in each principal coil than in each focusing coil. The stronger field around each principal coil may be set up by the existence of a larger current in each principal coil than in each focusing coil.

All of the coils may have the same number of turns and substantially the same current therethrough so that the magnetomotive force due to each coil is substantially the same. Where there are, for example, four coils that are all principal coils, it will be appreciated that, in operation, the flux density of the field that links the innermost pair of coils is greater than the flux density of the respective field that links each the two outermost pairs of coils. In this respect the innermost pair of coils act as principal coils and each of the two outermost pairs of coils act as focusing coils, even though each coils includes the same number of turns and conducts substantially the same current.

One ore more permanent magnets may be substituted for one or more principal and/or focusing coils.

BRIEF DESCRIPTION OF THE DRAWINGS

Specific, preferred, embodiments of this invention are below described by way of example only and with reference to the accompanying drawings, in which.

DESCRIPTION OF PREFERRED EMBODIMENTS

Figure 1:
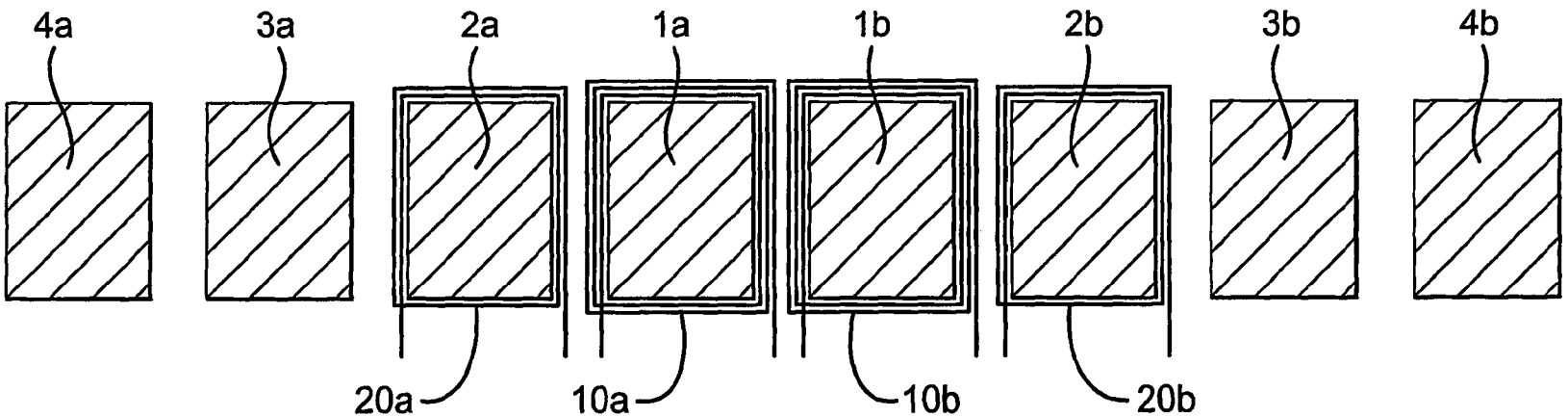
FIG. 1 is a schematic plan view of a series of members of magnetisable material, together with coils of magnetising means.

FIG. 1 shows eight members of unmagnetised magnetisable material 1*a*, 1*b*, 2*a*, 2*b*, 3*a*, 3*b*, 4*a*, 4*b*. The members are thin plates and the material is Neodymium-Iron-Boron (Ne—Fe—B). The members are mounted in a circumferential array on a rotor plate of a permanent magnet alternating current machine, but for clarity they are shown in a linear array in FIG. 1. Also shown are four coils 10*a*, 10*b*, 20*a*, 20*b* of magnetising means, the coils being connected in series. The rest of the magnetising means (not shown) is operable to cause an electric current to flow through each coil such that a respective magnetic field is set up around each coil. The arrangement of such means is known to the skilled addressee and will not be described further. The two innermost coils 10*a*, 10*b* are termed "principal coils" and the two outermost coils 20*a*, 20*b* are termed "focusing coils". Each of the principal coils 10*a*, 10*b* has a first number of turns and each of the focusing coils has a second number of turns, the first number being larger than the second number. It will be appreciated that, all other things being equal, the current would tend to set up a stronger field around each of the principal coils than that which would be set up around each of the focusing coils.

In operation of this exemplary embodiment, the rotor plate is rotatably mounted so as to lie generally horizontally, the members being mounted on an uppermost surface of the rotor plate. The coils 10*a*, 10*b*, 20*a*, 20*b* are presented adjacent a first group of four unmagnetised members 1*a*, 1*b*, 2*a*, 2*b*, such that each coil lies slightly above a respective member and in a plane that is parallel to the respective member. The magnetising means is operated such that a current flows in each of the coils in series. As stated above, this current sets up a respective magnetic field around each of the coils 10*a*, 10*b*, 20*a*, 20*b*. The direction of the current in each coil is not the same. In the focusing coil 20*a* and the principal coil 10*b* that is furthermost therefrom, the direction of the current when viewed from above is clockwise. In the focusing coil 20*b* and the principal coil 10*a* that is furthermost therefrom, the direction of the current when viewed from above is anticlockwise.

The effect of the current in each of the principal coils will now be considered. The current in the coil 10*a* sets up a field around that coil. The direction of the field is such that there is a flux path upwards through the centre of the coil 10*a* and upwards through the respective member 1*a*. This causes the member 1*a* to be substantially magnetised, the uppermost face of the member 1*a* being induced with a north-seeking polarity. The current in the coil 10*b* sets up a field around that coil. The direction of the field around the coil 10*b* is such that there is a flux path downwards through the centre of the coil 10*b* and downwards through the respective member 1*b*. This causes the member 1*b* to be substantially magnetised, the uppermost face of the member being induced with a south-seeking polarity. It will be appreciated that these two flux paths will tend to interact to form a closed loop of flux through each of the two principal coils 10*a*, 10*b* and through each of the respective members 1*a*, 1*b*. However not all the flux passing through the centre of each of the principal coils 10*a*, 10*b* will follow this closed loop: there will be some flux leakage. If unchecked, this flux leakage may interact with one or more of the members, or with adjacent material, to disturb the magnetic properties of the members or of the adjacent material.

The current in the focusing coil 20*a* sets up a field around that coil. The direction of the field is such that, with reference to FIG. 1, there is a flux path downwards through the centre of the coil 20*a* and downwards through the respective member 2*a*. As stated above, the strength of this field is less (ie it has a lower magnetomotive force or "mmf") than that associated with each of the principal coils 10*a*, 10*b* and although a south-seeking polarity may be induced in the uppermost face of the respective member 2*a*, it will be of a lower magnitude than the polarities induced in either of the members 1*a*, 1*b*. Member 2*a* may therefore be considered to be partially magnetised. The primary purpose of the focusing coil 20*a* is to control some of the leakage flux from the adjacent principal coil 10*a*. The flux path through the focusing coil 20*a* will tend to interact with the leakage flux from the adjacent principal coil 10*a* to form a closed loop of flux through the centre of the focusing coil 20*a*, the centre of the adjacent principal coil 10*a*, and through the member 1*a* and the member 1*b*, although there will be some flux leakage from the focusing coil 20*a*, this will be less than that which would tend to leak from the adjacent principal coil 10*a* in the absence of the focusing coil 20*a*. This is because the field set up around the focusing coil 20*a* is weaker than that set up around the adjacent principal coil 10*a*. The amount of flux leakage from the focusing coil 20*a* is considered tolerable.

The focusing coil 20*b* is substantially the same as the focusing coil 20*a*, with the exception that the direction of the current, and hence the direction of the associated field is reversed. In light of the foregoing description of the interaction between the focusing coil 20*a* and the principal coil 10*a*, it will be appreciated that the focusing coil 20*b* interacts with the principal coil 10*b* in substantially the same fashion to control the flux leakage from the principal coil 10*b*.

Having magnetised the members 1*a* and 1*b*, the current is ceased and the coils 10*a*, 10*b*, 20*a* 20*b* are retracted from the uppermost surfaces of the respective members 1*a*, 1*b*, 2*a*, 2*b*. The rotor plate is indexed so that it rotates through an angle that corresponds to a pitch of two members. The coils 10*a*, 10*b*, 20*a*, 20*b* are then presented adjacent a second group of members 1*b*, 2*b*, 3*b*, 4*b*, the member 1*b* having been magnetised in the previous operation, the member 2*b* having been partially magnetised in the previous operation and the members 3*b* and 4*b* being as yet unmagnetised. In this way the second group may be seen to overlap the first group by a margin of two members. The coils are again positioned such that each coil lies slightly above a respective member and in a plane that is parallel to the respective member. The magnetising operation described above is repeated. The members 2*b* and 3*b* are magnetised by the principal coils 10*a* and 10*b* respectively. The focusing coils 20*a* and 20*b* tend to control the flux leakage from the respective adjacent principal coil 10*a*, 10*b* such that the south-seeking polarity of the uppermost face of the previously magnetised member 1*b* is preserved, or even enhanced thereby, and the uppermost face of the member 4*b* is partially magnetised with a north-seeking polarity.

This is repeated until each of the members on the rotor plate has been magnetised by a respective one of the principal coils 10*a* and 10*b*. In so doing, it will be appreciated that the final position will be one where the focusing coil 20*b* is above the member 1*a* and the principal coil 10*a* is above the member 2*a* i.e. the coils have come back to the beginning of the array so as to finish with an overlap of two members.

Although the apparatus and method are particularly suited to magnetising members on such a rotor plate, it is envisaged that the apparatus and the method may be used to magnetise adjacent members of magnetisable material in many applications. It is envisaged that the apparatus and method may be used to magnetise any number of members, it being understood that eight members are shown in FIG. 1 and discussed above for the sake of clarity and conciseness.

Rather than providing more turns in each of the principal coils than in each of the focusing coils, all the coils may have the same number of turns, but may carry a different current. A larger current in each of the principal coils than in each of the focusing coils would have the desired effect of setting up a stronger field around the principal coils than that which would be set up around the focusing coils.

Alternatively, all the coils may be principal coils in that each may have the same number of turns and the same current therein. This would result in the mmf of each coil being substantially the same. It is envisaged that this might result in more flux leakage from outermost ones of the coils than would the arrangement described above with reference to FIG. 1, but that there would still be a tendency for the mmfs of each coil to interact and result in a combined field, flux of which substantially follows a predictable and preferred path by forming closed loops through pairs of the coils.

Such an arrangement would nevertheless be advantageous, for example where there are four coils, as in the embodiment described with reference to FIG. 1, but wherein all of the coils have the same number of turns and substantially the same current therethrough so that the magnetomotive force due to each coil is substantially the same, in operation, the flux density of the field that links the innermost pair of coils would be greater than the flux density of the respective field that links each the two outermost pairs of coils. In this respect the innermost pair of coils act as principal coils and each of the two outermost pairs of coils act as focusing coils, even though each coils includes the same number of turns and conducts substantially the same current.

In the arrangement described with reference to FIG. 1, only four coils are provided. However any number of coils are envisaged, that number including any number of principal coils or focusing coils. Intermediate coils may be provided between the principal coils and the focusing coils, each intermediate coil having an mmf associated therewith that is weaker than that associated with each principal coil, but stronger than that associated with each focusing coil. This would allow the field set up around the focusing coils to be further reduced, thereby further reducing the amount of flux leakage therefrom.

In another embodiment, it is envisaged that a respective coil is provided for positioning adjacent each member. The members would be magnetised in successive overlapping groups as is the case in the first embodiment described above. However, rather that moving the principal coils and the focusing coils mechanically relative to the members, currents would be passed through a group of, for example, four of the coils such that the two innermost coils act as principal coils and two principal coils act as focusing coils. Once the two members adjacent the two principal coils had been magnetised, currents would be passed through another group of four coils such that, again, the two innermost coils act as principal coils and the two outermost coils act as focusing coils, the other group over lapping the one group by a margin of two coils. In this way each of the members may be magnetised by a respective principal coil.

Figure 2:
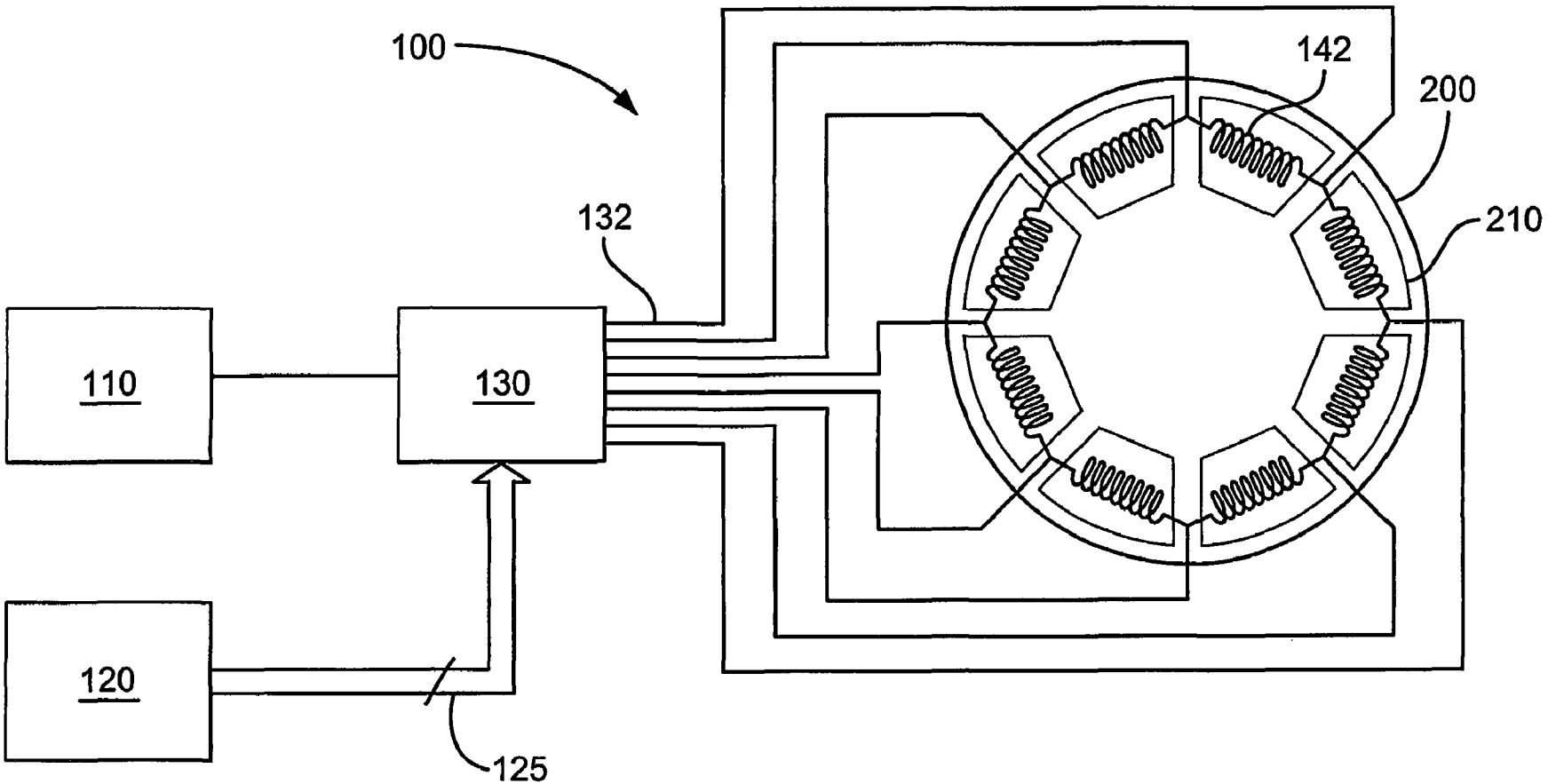
FIG. 2 is a schematic diagram of an alternative magnetising means for magnetising members mounted on a rotor plate on an electrical machine.

A further embodiment, similar to this other embodiment, is described with reference to FIG. 2. FIG. 2 shows, in schematic form, magnetising means 100 and a rotor plate 200 suitable for use in an electrical machine (not shown). The rotor plate 200 has a number of substantially unmagnetised plate-like members 210 of Neodymium-Iron-Boron mounted thereon in a circular array. In this alternative embodiment there are eight members 210. The magnetising means 100 include a current source 110, a computer 120, switching circuitry 130 and field generation and control means.

Output terminals of the current source 110 are connected to current input terminals of the switching circuitry 130. The current source is arranged to supply periodically a large current, typically of the order of 10 A–100 kA, to the current input terminals of the switching circuitry 130. It is envisaged that the current source 110 may use capacitative discharge in order to supply this current.

The computer 120 is a processing unit, having a memory and being operable to execute a programme stored therein. It is envisaged that a microprocessor or a conventional Personal Computer may be used as the computer 120. An output of the computer 120 is connected to a second input of the switching means 130 along control bus 125.

The switching circuitry 130 includes eight switchable terminals 132. The arrangement of the circuitry 130 is such that the current input terminals can be connected across any selected pair of the eight switchable terminals 132 in response to a control signal from the computer 120 along control bus 125, such that a current can flow between the selected pair of terminal 132 in either direction. It is envisaged that thyristors, IGBTs or similar components may be used a principal switching components of the switching circuitry 130. The switching circuitry 130 preferably includes one or more snubber devices (not shown) to limit the voltage across each of the principal switching components so as to prevent damage thereof.

The field generation and control means consists of a respective coil 142 for each member 210 of the rotor plate 200. Accordingly, there are eight coils 142. Each coil 142 contains the same number of turns as each other coil 142 and the coils 142 are arranged in a circular array, similarly to that of the members 210. Each end of each coil 142 is connected to a respective one of the eight switchable terminals 132 of the switching circuitry 130. It is envisaged that the coils 142 may be conveniently housed in a magnetising head (not shown).

In operation, the rotor plate 200 is supported so that it lies in a generally horizontal plane. The magnetising head, with the coils 142 arranged therein, is placed above the rotor plate 200 so that each coil 142 is above and adjacent a respective one of the plates 210 that are to be magnetised. Capacitors in the current source 110 are charged and the programme stored in the computer 120 is executed.

In executing the programme, the computer 120 sends a control signal to the switching circuitry 130 along control bus 125 such that the switching circuitry 130 connects its current input terminals across a selected first juxtaposed pair of the coils 142. The switching is such that the current stored in the current source 110 discharges so as to flow through each coil 142 of the selected first pair in an opposite direction. Corresponding magnetic fields are set up around each coil 142 of the selected first pair. These magnetic fields interact to give a combined magnetic field. The flux path of this combined magnetic field is from a first one of the coils 142 of the selected first pair across an airgap and downwards into the respective member 210, out of that member 210 and circumferentially through material of the rotor plate 200, into the juxtaposed member 210 with which the other coil 142 of the selected first pair is coupled. The flux path continues out of that other member 210 in an upwards direction, across the airgap and through that other coil 142. The flux path is completed upwards out of that other coil 142 and downwards into the first coil 142. In this way, both of the coils 142 across which the current has been connected act as field generation means and control means and may both be considered as principal coils. The substantially closed flux path through the two coils 142, the two members 210 and the rotor plate 200 is advantageous in minimising uncontrolled flux leakage which may have a deleterious effect on other ones of the members 210.

After a period of time in which the current source 110 is considered to have substantially discharged, the computer 120 controls the switching circuitry 130 such that the current input terminals are no longer connected to the first pair of coils 142. This allows the current source 110 to recharge. After an appropriate delay, the computer 120 sends another control signal to the switching circuitry 130 such that the current input terminals thereof are connected across a second pair of coils 142 such that current flows therethrough and those coils are energised. It is envisaged that the other pair of coils 142 is adjacent the first pair of coils 142 and that these two pairs may overlap by one coil 142. An overlap is advantageous in preserving or increasing the level of magnetisation in the member 210 that is adjacent the overlapping coil 142.

This is repeated until all the coils 142 have been energised in successive overlapping pairs, a final pair overlapping with the first pair and such that all of the members 210 have been magnetised as required. Thus, a first notional "revolution" of the circular array of coils 142 is completed. This arrangement whereby different pairs of coils 142 are energised in turn may be considered as a form of "multiplexing". It is envisaged that each members 210 may be repeatedly magnetised in this way to progressively build-up the level of magnetisation of that member 210. This is advantageous in that the current which must be periodically discharged from the current source 110 may be smaller and/or may be of a substantially shorter duration than would be necessary if each member 210 were magnetised to the required level of magnetisation in a single operation. This may be achieved by the overlap of pairs of energised coils 142 or more as described above. Alternatively, or in addition to this, the members 210 may be subjected to two or more of the aforementioned notional revolutions of the circular array of coils 142. A further alternative or addition would be to repeatedly energise each selected pair of coils 142 before the next selected pair of coils 142 is energised.

In variations of the alternative embodiment described above, more than two coils 142 may be energised at any one time. Furthermore, the switching circuitry may be such that the current in each outermost coil 142 of a group of coils that are energised simultaneously is weaker than that in the inner coils of the group, such that the outermost coils 142 act as focusing coils in the manner described above.

Figure 3:
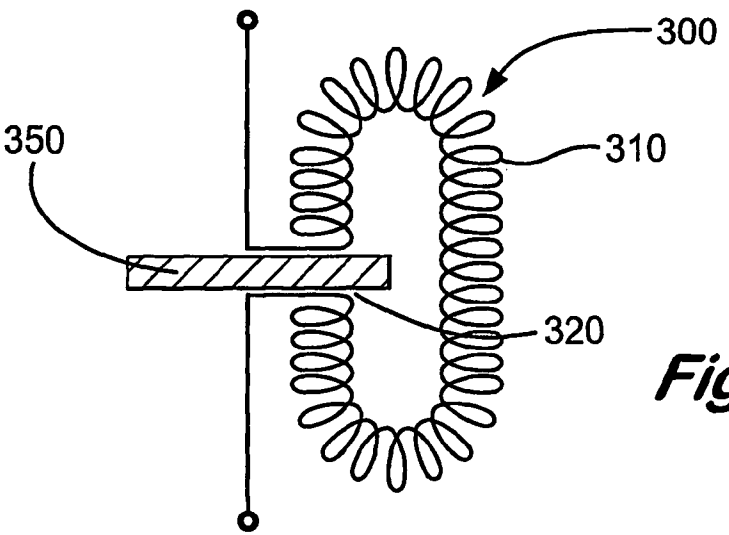
FIG. 3 is a schematic view of another alternative magnetising means for magnetising one or more portions of a member of magnetisable material.

FIG. 3 shows another alternative embodiment in which magnetising means 300 and a member 350 of magnetisable material are depicted schematically and in cross section respectively. The magnetising means 300 is a single helical coil 310, the ends of which have been bent around so that the coil 310 resembles a split "O" shape, or a rounded horseshoe shape. The ends of the coils 310 are connected to a current source (not shown). There is a small gap 320 between the ends of the coil 310. The gap is of sufficient size to receive the member 350 of magnetisable material.

In operation, the member, which is plate-like, is inserted into the gap 320 such that one surface of the member 350 is adjacent one of the ends of the coil 310 and the other surface of the member 350 is adjacent the other end of the coil 310, a portion of the member 350 lying between the two ends. The current source is operable to supply a current to the coil 310. The current, when it flows in the coil 310, causes a magnetic field to be set up therearound. Flux of this field follows a substantially closed loop around the inside of the coil, travelling through the portion of the member 350. As a result the portion of the member 350 becomes at least partially magnetised.

The member 350 is then moved relative to the coil 310 so that another portion of the member 350 lies between the ends of the coil. The current source is then operated as before to supply a current to the coil 310 so as to at least partially magnetise the other portion. This can be repeated until some or all of the member is magnetised. Some portions may be repeatedly magnetised in this way. Different portions of the same member may be magnetized with different polarities and/or so as to be of differing strengths.

The shape of the coil 310 may be considered advantageous in encouraging the flux of the magnetic field to follow a preferred path through the turns of the coil 310 and minimising the amount of uncontrolled flux leakage from this preferred path.

As in the other embodiments described above, more than one coil 310 may be provided and those coils 310 may be multiplexed in a manner similar to that of the embodiment described with reference to FIG. 2, thereby removing the need for the or each coil 310 to be moved relative to the member 350.

The invention claimed is:

1. A magnetiser (100) for magnetising successive groups, each of at least one portion (210) of magnetisable material, the magnetiser (100) being arranged to magnetise the portions (210) sequentially, one group after another, the magnetiser (100) including a field generator (142) operable to generate a magnetic field, flux of which passes through each portion (210) in the group that is being magnetised, thereby at least partially magnetising each portion (210), characterised by the magnetiser (100) including a controller (142) operable to control the magnetic field such that flux thereof follows a preferred path through each portion (210) that is being magnetised and through the magnetiser (100) in a substantially closed loop and whereby uncontrolled flux leakage from each portion (210) and the magnetising means (100) is minimized, and wherein the field generator and the controller (142) include at least one pair of coils (142) in side-by-side juxtaposition so as to create a series of coils (142), each coil (142) being for placing adjacent the surface of a respective one of the portions (210), the magnetiser (100) being operable to supply a current to each coil (142) such that a respective magnetic field is set up therearound that passes through the surface of the respective adjacent portion (350), thereby at least partially magnetising that portion (350), the direction of the respective current in each coil (142) being opposite to the direction of the current in the or each juxtaposed coil (142) such that flux passes through the or each juxtaposed coil pair in opposite directions and forms a substantially closed path through that coil pair and the respective pair of adjacent portions (210), wherein said flux passes without the use of an iron core for routing the magnetic flux.

2. A magnetiser (100) according to claim 1 wherein the field generator and the controller (142) include a plurality of said coils (142) arranged in a circular array on a magnetiser head, the magnetiser head being for placing in face-to-face juxtaposition with a rotor plate (200) of an electrical machine on which are mounted a plurality of said portions (210) in the form of a circular array of separate members (210) of magnetisable material such that each coil (142) is adjacent a respective member (210), the magnetiser (100) being operable to sequentially supply current to selected juxtaposed pairs of the coils (142) so as to at least partially magnetise the respective adjacent pair of the members (210).

3. A magnetiser (100) according to claim 1 wherein the magnetiser (100) includes charge storage means (110) operable to be discharged and to thereby supply current to the coils (142).

4. Magnetising means (100) for magnetising successive groups, each of at least one portion (210) of magnetisable material, the magnetising means (100) being arranged to magnetise the portions (210) sequentially, one group after another, the magnetising means (100) including field generation means (142) operable to generate a magnetic field, flux of which passes through each portion (210) in the group that is being magnetised, thereby at least partially magnetising each portion (210);

characterised by the magnetising means (100) including control means (142) operable to control the magnetic field such that flux thereof follows a preferred path through each portion (210) that is being magnetised and through the magnetising means (100) in a substantially closed loop and whereby uncontrolled flux leakage from each portion (210) and the magnetising means (100) is minimized, said control apparatus (142) being adjacent a corresponding portion (210) and being operable to perform magnetisation without the need for movement of said portion or portions (210);

wherein the field generation and control means (142) include at least one pair of coils (142) is side-by-side juxtaposition so as to create a series of coils (142), each coil (142) being for placing adjacent the surface of a respective one of the portions (210), the magnetising means (100) being operable to supply a current to each coil (142) such that a respective magnetic field is set up therearound that passes through the surface of the respective adjacent portion (350), thereby at least partially magnetising that portion (350), the direction of the respective current in each coil (142) being opposite to the direction of the current in the or each juxtaposed coil (142) such that flux passes through the or each juxtaposed coil pair in opposite directions and forms a substantially closed path through that coil pair and the respective pair of adjacent portions (210); and wherein some of the coils (142) are principal coils (142), and others are focusing coils (142), the principal coils (142) being positioned innermost in the series and the focusing coils (142) being positioned outermost in the series, the field associated with each of the principal coils (142) being such that flux passing through each principal coil (142) tends to form a closed loop of flux through a respective juxtaposed principal coil (142) and through each of the two portions (210) adjacent the respective two principal coils (142), the field associated with each of the focusing coils (142) being such that some of the flux of the field associated with an adjacent principal coil (142) that does not form a closed loop through a respective juxtaposed principal coil (142) forms a closed loop with flux passing through a respective focusing coil (142), thereby reducing the amount of uncontrolled flux leakage from the adjacent principal coil (142).

5. Magnetising means according to claim 4 wherein the field associated with each principal coil (10*a*, 10*b*) is stronger than that associated with each focusing coil (20*a*, 20*b*), thereby maximising the tendency for flux of the field due to each principal coil (10*a*, 10*b*) to form a closed loop through the or each juxtaposed principal coil (10*a*, 10*b*).

6. A method of magnetising a plurality of adjacent portions (210) of magnetisable material mounted on a carrier (200), the method including the steps of:

a) magnetising a first group of one or more of the portions (210) by operation of a magnetiser means (100); and b) magnetising one or more successive groups of one ore more of the portions (210) by the operation of the magnetiser means (100), whereby the plurality of adjacent portions (210) can be magnetised sequentially, one group after another, the magnetiser means (100) including a field generator (142) operable to generate a magnetic field, flux of which passes through the or each portion (210) in the group that is being magnetised, thereby at least partially magnetising the or each portion (210), characterised by the magnetiser (100) including a controller (142) operable to control the magnetic field such that flux thereof follows a preferred path through the or each portion (210) that is being magnetised and through the magnetiser (100) in a substantially closed loop and whereby uncontrolled flux leakage from the or each portion (210) and the magnetiser (100) is minimized, and wherein the portions (210) are positioned in a circular array on a component (200) of an electrical machine, each portion (210) being of a portion (210) of a different respective member (210) of magnetisable material and each member (210) being juxtaposed with two others of the members (210), and wherein each group includes at least two juxtaposed members (210), each group other than a first magnetised group includes at least one member (210) that was in the respective previous group, each group other than a last magnetised group includes at least one member (210) that is subsequently included in the respective subsequent group, and the first magnetised group and the last magnetised group have at least one member (210) in common, wherein said flux passes without the use of an iron core for routing the magnetic flux.

7. A magnetiser (100) for magnetising successive groups, each of at least one portion (210) of magnetisable material, the magnetiser (100) being arranged to magnetise the portions (210) sequentially, one group after another, the magnetiser (100) including a field generator (142) operable to generate a magnetic field, flux of which passes through each portion (210) in the group that is being magnetised, thereby at least partially magnetising each portion (210), characterised by the magnetiser (100) including a controller (142) operable to control the magnetic field such that flux thereof follows a preferred path through each portion (210) that is being magnetised and through the magnetiser (100) in a substantially closed loop and whereby uncontrolled flux leakage from each portion (210) and the magnetising means (100) is minimized, and wherein the field generator and the controller (142) include at least one pair of coils (142) in side-by-side juxtaposition so as to create a series of coils (142), each coil (142) being for placing adjacent the surface of a respective one of the portions (210), the magnetiser (100) being operable to supply a current to each coil (142) such that a respective magnetic field is set up therearound that passes through the surface of the respective adjacent portion (350), thereby at least partially magnetising that portion (350), the direction of the respective current in each coil (142) being opposite to the direction of the current in the or each juxtaposed coil (142) such that flux passes through the or each juxtaposed coil pair in opposite directions and forms a substantially closed path through that coil pair and the respective pair of adjacent portions (210), wherein said flux passes without the use of an iron core for routing the magnetic flux.

8. A magnetiser (100) according to claim 7 wherein the magnetiser (100) includes charge storage means (110) operable to be discharged and to thereby supply current to the coils (142).

9. A magnetiser (100) for magnetising successive groups, each of at least one portion (210) of magnetisable material, the magnetiser (100) being arranged to magnetise the portions (210) sequentially, one group after another, the magnetiser (100) including a field generator (142) operable to generate a magnetic field, flux of which passes through each portion (210) in the group that is being magnetised, thereby at least partially magnetising each portion (210), characterised by the magnetiser (100) including a controller (142) operable to control the magnetic field such that flux thereof follows a preferred path through each portion (210) that is being magnetised and through the magnetiser (100) in a substantially closed loop and whereby uncontrolled flux leakage from each portion (210) and the magnetising means (100) is minimized, and wherein the field generator and the controller (142) include at least one pair of coils (142) in side-by-side juxtaposition so as to create a series of coils (142), each coil (142) being for placing adjacent the surface of a respective one of the portions (210), the magnetiser (100) being operable to supply a current to each coil (142) such that a respective magnetic field is set up therearound that passes through the surface of the respective adjacent portion (350), thereby at least partially magnetising that portion (350), the direction of the respective current in each coil (142) being opposite to the direction of the current in the or each juxtaposed coil (142) such that flux passes through the or each juxtaposed coil pair in opposite directions and forms a substantially closed path through that coil pair and the respective pair of adjacent portions (210);

and wherein some of the coils (142) are principal coils (142), and others are focusing coils (142), the principal coils (142) being positioned innermost in the series and the focusing coils (142) being positioned outermost in the series, the field associated with each of the principal coils (142) being such that flux passing through each principal coil (142) tends to form a closed loop of flux through a respective juxtaposed principal coil (142) and through each of the two portion (210) adjacent the respective two principal coils (142), the field associated with each of the focusing coils (142) being such that some of the flux of the field associated with an adjacent principal coil (142) that does not form a closed loop through a respective juxtaposed principal coil (142) forms a closed loop with flux passing through a respective focusing coil (142), thereby reducing the amount of uncontrolled flux leakage from the adjacent principal coil (142).

10. A magnetiser (100) according to claim 9 wherein the field associated with each principal coil (10*a*, 10*b*) is stronger than that associated with each focusing coil (20*a*, 20*b*), thereby maximising the tendency for flux of the field due to each principal coil (10*a*, 10*b*) to form a closed loop through the or each juxtaposed principal coil (10*a*, 10*b*).

* * * * *